US009785094B2

(12) United States Patent
Takino

(10) Patent No.: US 9,785,094 B2
(45) Date of Patent: Oct. 10, 2017

(54) IMAGE FORMING APPARATUS

(71) Applicant: Oki Data Corporation, Tokyo (JP)

(72) Inventor: Yuji Takino, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/215,360

(22) Filed: Jul. 20, 2016

(65) Prior Publication Data

US 2017/0060036 A1 Mar. 2, 2017

(30) Foreign Application Priority Data

Aug. 26, 2015 (JP) ..... 2015-166530

(51) Int. Cl.
*G03G 15/00* (2006.01)
*G03G 15/16* (2006.01)
*G03G 15/01* (2006.01)

(52) U.S. Cl.
CPC ..... *G03G 15/1605* (2013.01); *G03G 15/0189* (2013.01); *G03G 15/0131* (2013.01); *G03G 15/0178* (2013.01); *G03G 2215/0119* (2013.01)

(58) Field of Classification Search
CPC ..... G03G 2215/0119
USPC ..... 399/299
See application file for complete search history.

(56) References Cited

U.S. PATENT DOCUMENTS 4,847,658 A * 7/1989 Takebe ..... G03G 15/08 355/77
4,897,331 A * 1/1990 Toyoshi ..... G03G 13/22 430/100
5,077,158 A * 12/1991 Nakano ..... G03G 9/08 430/103
5,113,221 A * 5/1992 Kotani ..... G03G 15/5029 399/381
5,915,144 A * 6/1999 Ide ..... G03G 13/013 399/298
2008/0138121 A1* 6/2008 Tamaki ..... G03G 15/161 399/302
2008/0152389 A1* 6/2008 Kim ..... G03G 15/0121 399/223
2008/0152397 A1* 6/2008 Bae ..... G03G 15/0121 399/298
2008/0153017 A1* 6/2008 Park ..... G03G 15/0194 430/48

(Continued)

FOREIGN PATENT DOCUMENTS

JP 2014-032280 A 2/2014

*Primary Examiner* — Clayton E LaBalle
*Assistant Examiner* — Kevin Butler
(74) *Attorney, Agent, or Firm* — Rabin & Berdo, P.C.

(57) ABSTRACT

An image forming apparatus includes a first image forming section, a second image forming section, and a transfer section. The first image forming section forms an image layer by a first developer. The second image forming section forms an auxiliary layer by a second developer. The transfer section transfers the image layer formed by the first image forming section and the auxiliary layer formed by the second image forming section sequentially to an object, as a transfer object, on which transfer is to be performed. The following expression is satisfied: $0.30 \leq (E2/E1) \leq 1.00$, where E1 is a charge amount of the first developer, and E2 is a charge amount of the second developer.

15 Claims, 9 Drawing Sheets

(56) References Cited

U.S. PATENT DOCUMENTS

| | | | | |
|---|---|---|---|---|
| 2008/0159787 | A1* | 7/2008 | Lee | G03G 15/0194 399/223 |
| 2014/0037311 | A1* | 2/2014 | Mitsunobu | G03G 15/0121 399/46 |

* cited by examiner

| PRINT METHOD | 2-PASS PRINTING | 1-PASS PRINTING | | |
|---|---|---|---|---|
| | REFERENCE EXAMPLE | COMPARATIVE EXAMPLE | EXAMPLE 1 | EXAMPLE 2 |
| E1:CHARGE AMOUNT OF COLOR TONER(μC/g) | -13.6 | -13.6 | -13.6 | -13.6 |
| E2:CHARGE AMOUNT OF WHITE TONER(μC/g) | -2.7 | -2.7 | -4.2 | -7.5 |
| (E2/E1):RATIO OF CHARGE AMOUNTS | 0.20 | 0.20 | 0.30 | 0.55 |
| PRINTING RESULT | | | | |
| VISUAL DETERMINATION | — | C | B | A |
| CONCENTRATION DETERMINATION | — | B | A | A |
| | | (E2/E1)<0.30 | 0.30≦(E2/E1)≦1.00 | |

FIG. 7

IMAGE FORMING APPARATUS

CROSS REFERENCE TO RELATED APPLICATIONS

This application claims the benefit of Japanese Priority Patent Application JP 2015-166530 filed on Aug. 26, 2015, the entire contents of which are incorporated herein by reference.

BACKGROUND

The invention relates to an image forming apparatus that uses a developer (a toner) to form an image.

An image forming apparatus may perform image formation on a print medium such as paper, and may thereafter perform fixing and paper discharging. For example, reference is made to Japanese Unexamined Patent Application Publication No. 2014-32280.

SUMMARY

It is desirable that an image forming apparatus provide a favorable image (to improve image quality).

It is desirable to provide an image forming apparatus that makes it possible to improve image quality.

An image forming apparatus according to an illustrative embodiment of the invention includes: a first image forming section that forms an image layer by a first developer; a second image forming section that forms an auxiliary layer by a second developer; and a transfer section that transfers the image layer formed by the first image forming section and the auxiliary layer formed by the second image forming section sequentially to an object, as a transfer object, on which transfer is to be performed. The following expression is satisfied:

$$0.30 \leq (E2/E1) \leq 1.00 \quad (1)$$

where E1 is a charge amount of the first developer, and E2 is a charge amount of the second developer.

BRIEF DESCRIPTION OF THE DRAWINGS

FIG. 7 is a diagram illustrating printing results, etc. according to a reference example, a comparative example, and examples 1 and 2.

DETAILED DESCRIPTION

Hereinafter, some example embodiments of the invention are described in detail with reference to drawings. The description is given in the following order.

1. Embodiment (an example where a negatively-charged toner is used in an intermediate-transfer image forming apparatus)
2. Modifications Modification 1 (an example where a positively-charged toner is used in an intermediate-transfer image forming apparatus)

Modification 2 (an example in which a directly-transfer image forming apparatus is employed)

3. Other modifications

1. Example Embodiment

[Outline Configuration]

Figure 1:
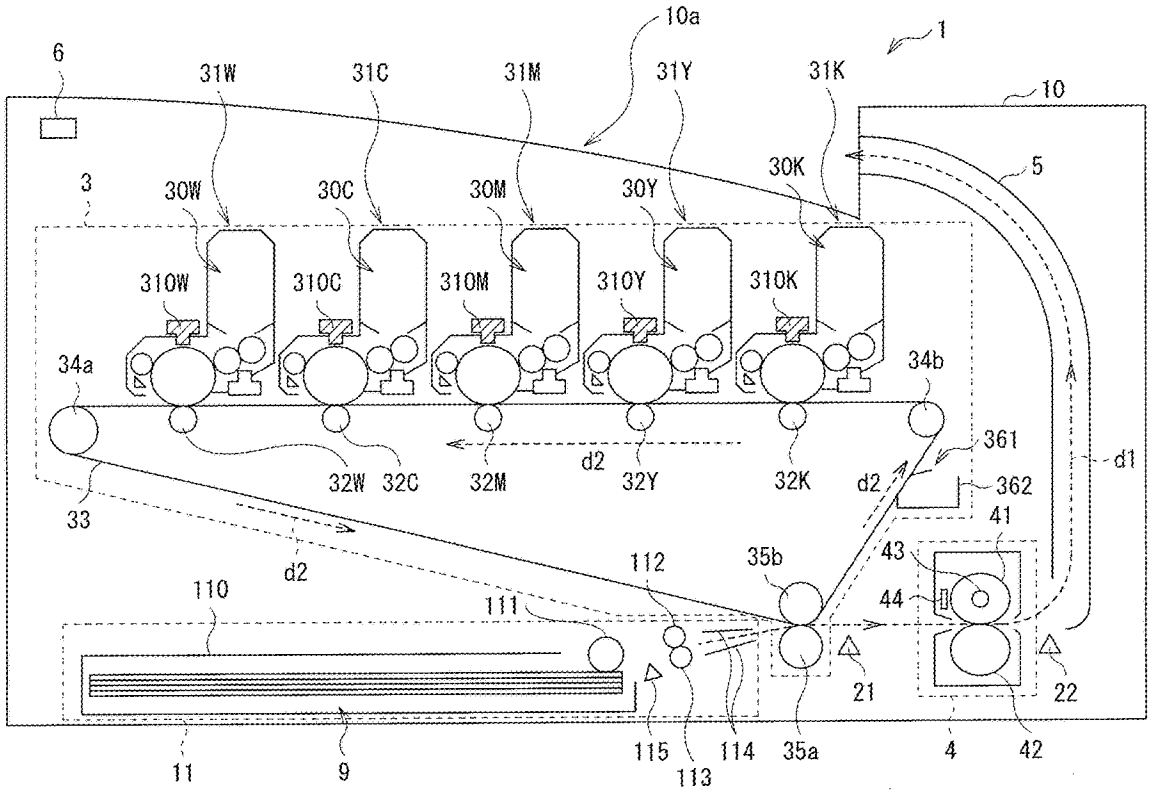
FIG. 1 is a schematic diagram illustrating an outline configuration example of an image forming apparatus according to an example embodiment of the invention.

FIG. 1 schematically illustrates an outline configuration example of an image forming apparatus (an image forming apparatus 1) according to an example embodiment of the invention. The image forming apparatus 1 may function as a printer (a color printer in this example) that forms an image (a color image in this example) on a print medium 9 with use of an electro-photography system. Also, as described below, the image forming apparatus 1 may be a so-called intermediate-transfer image forming apparatus that transfers toner images to the print medium 9 through an intermediate transfer belt 33 described later. The image forming apparatus may correspond to a specific but non-limiting example of an "image forming apparatus" in one embodiment of the invention.

As illustrated in FIG. 1, the image forming apparatus 1 may include a feeding mechanism 11, a secondary transfer discharge sensor 21, a fixing discharge sensor 22, an image forming mechanism 3, a fixing unit 4, a guide 5, and an environment sensor 6. As illustrated in FIG. 1, these members may be contained in a predetermined housing 10 that includes an openable and closable cover (not illustrated) and other components.

[Feeding Mechanism 11]

The feeding mechanism 11 may be a mechanism that sends out (feeds) the print medium 9 toward a secondary transfer roller 35*a* described later. As illustrated in FIG. 1, the feeding mechanism 11 may include a cassette 110, a hopping roller 111, a pinch roller 112, a resist roller 113, a guide 114, and a feeding sensor 115.

The cassette 110 may be a member that contains the print medium 9 in a stacked state. In the example illustrated in FIG. 1, the cassette 110 may be a built-in tray that is detachably mounted at a lower part in the image forming apparatus 1.

The hopping roller 111 may be a member that separates and draws the print medium 9 contained in the cassette 110, one by one from an uppermost thereof, and feeds the print medium 9 toward the pinch roller 112 and the resist roller 113. The pinch roller 112 may be a member that corrects skew when the print medium 9 is skewed (is conveyed obliquely). The resist roller 113 may be a member that conveys the print medium 9 that has been fed by the hopping roller 111, toward the secondary transfer roller 35*a* described later. The guide 114 may be a member that guides, toward the secondary transfer roller 35*a*, the print medium 9 that has been conveyed by the resist roller 113. The feeding sensor 115 may be a sensor detecting that the print medium 9 that has been fed by the hopping roller 111 has arrived at a region between the pinch roller 112 and the resist roller 113.

[Image Forming Mechanism 3]

The image forming mechanism 3 may perform image formation (printing) on the print medium 9 that has been conveyed by the feeding mechanism 11. As illustrated in FIG. 1, the image forming mechanism 3 may include five image drum units (image forming units) 31K, 31Y, 31M, 31C, and 31W and the secondary transfer roller 35*a* in this example. The image forming mechanism 3 may also include five primary transfer rollers 32K, 32Y, 32M, 32C, and 32W, an intermediate transfer belt 33, a driving roller 34*a*, a driven roller 34*b*, a secondary transfer counter roller 35*b*, a cleaning blade 361, and a waste toner tank 362 that function as an intermediate transfer belt unit.

As illustrated in FIG. 1, the image drum units 31K, 31Y, 31M, 31C, and 31W may be arranged side by side along a conveying direction (a conveying path) d2 of the intermediate transfer belt 33 described later. More specifically, the image drum units 31K, 31Y, 31M, 31C, and 31W may be arranged in this order along the conveying direction d2 (from upstream toward downstream). The image drum units 31K, 31Y, 31M, 31C, and 31W may be individually mounted on respective predetermined mount positions (five mount positions in this example) in the housing 10 in the above-described order.

The image drum units 31K, 31Y, 31M, and 31C each may correspond to a specific but non-limiting example of a "first image forming section" in one embodiment of the invention. The image drum unit 31W may correspond to a specific but non-limiting example of a "second image forming section" in one embodiment of the invention. Also, the above-described conveying direction d2 in the present example embodiment may correspond to a specific but non-limiting example of a "conveying path" in one embodiment of the invention.

These image drum units 31K, 31Y, 31M, 31C, and 31W may form images (toner images, or image layers) on the intermediate transfer belt 33 described later with use of respective toners (respective developers) that are different in color from one another. More specifically, as illustrated in FIG. 1, the image drum unit 31K may use a black (K) toner (a toner 30K) to form a black toner image, and the image drum unit 31Y may use a yellow (Y) toner (a toner 30Y) to form a yellow toner image. Likewise, the image drum unit 31M may use a magenta (M) toner (a toner 30M) to form a magenta toner image, and the image drum unit 31C may use a cyan (C) toner (a toner 30C) to form a cyan toner image. The image drum unit 31W uses a white (W) toner (a toner 30W) to form a white toner image.

The toners 30K, 30Y, 30M, 30C, and 30W of the respective colors each may include an external additive added to toner base particles that contain at least a binding resin. The external additive may be inorganic fine powder or organic fine powder.

As the above-described binding resin, for example but not particularly limited to, a polyester-based resin, a styrene-acryl-based resin, an epoxy-based resin, and a styrene-butadiene-based resin may be preferable. A mold releasing agent, a colorant, or any other additive may be added to the binding resin, and an additive such as a charge control agent, an electro-conductive modifier, a flow improver, and a cleaning property improver may be added on an as-needed basis. The binding resin may be a mixture of a plurality of kinds of resins. In examples described later, a polyester resin having a crystalline structure may be used in addition to a plurality of amorphous polyester-based resins.

As a method of fabricating the above-described toner base particles, for example, a grinding method may be used. In the grinding method, materials other than the external additive, such as the binding resin, the mold releasing agent, and the charge control agent, may be previously melted and kneaded with use of an extrusion molding machine, a biaxial kneader, etc. to form a lump of the toner base particles. The lump may be cooled and roughly ground thereafter by, for example, a cutter mill, and the roughly-ground lump may thereafter be ground by a collision grinder to form particles. Thereafter, the particles may be classified by a wind force classifier or any other scheme to obtain the toner base particles with predetermined particle diameters.

Examples of the above-described mold releasing agent may include: without particular limitation, low-molecular weight polyethylene; low-molecular weight polypropylene; olefin copolymer; aliphatic hydrocarbon wax such as microcrystalline wax, paraffin wax, and Fischer Tropsch wax; an oxide of aliphatic hydrocarbon wax such as polyethylene oxide wax; a block copolymer thereof; wax containing fatty acid ester as a main component, such as carnauba wax and montanoic acid ester wax; and wax whose fatty acid ester is partially or wholly deoxidized, such as deoxidized carnauba wax. For example, the effective content of the mold releasing agent to be added may be 0.1 to 20 (parts by weight (pts.wt.)), more preferably 0.5 to 12 (pts.wt.), with respect to 100 (pts.wt.) of the binding resin, and combination use of a plurality of wax may be also preferable.

As the above-described colorant used for the color toners (the toners 30K, 30Y, 30C, and 30M), for example but not particularly limited to, dyes and pigments used as a colorant for a black toner, an yellow toner, a magenta toner, and a cyan toner may be used singly or in combination. More specifically, examples thereof may include carbon black, iron oxide, phthalocyanine blue, permanent brown FG, brilliant fast scarlet, pigment green B, rhodamine-B base, solvent red 49, solvent red 146, pigment blue 15:3, solvent blue 35, quinacridone, carmine 6B, and disazo yellow.

Examples of the above-described colorant used for the white toner (the toner 30W) may include titanium oxide, aluminum oxide, barium sulfate, and zinc oxide.

The effective content of such a colorant to be added may be 2 to 25 (pts.wt.), more preferably 2 to 15 (pts.wt.), with respect to 100 (pts.wt.) of the binding resin.

As the above-described charge control agent, any of known agents may be used. For example, in the case of the negatively-charged toner, examples of the charge control agent may include an azo-based complex charge control agent, a salicylic acid-based complex charge control agent, and a calyx allene-based charge control agent. The effective content of the charge control agent to be added may be, for example, 0.05 to 15 (pts.wt.) with respect to 100 (pts.wt.) of the binding resin. In examples described later, 1.0 (pts.wt.) of BONTRON P-51 (commercially available from Orient Chemical Industries Co., Ltd. located in Osaka, Japan) may be added as the charge control agent to each of the color toners (the toners 30K, 30Y, 30M, and 30C). As for the white toner (the toner 30W), the charge control agent may be added by varying the additive amount thereof, to prepare some samples, i.e., a white toner A (with 0.5 pts.wt. of BONTRON P-51), a white toner B (with 9.0 pts.wt.), and a white toner C (with 12.0 pts.wt.).

The above-described external additive may be added to improve factors such as environmental stability, charging stability, developing property, fluidity, and storage property, and any of known additives may be used as the external additive. The content of the external additive to be added may be, for example, 0.01 to 10 (pts.wt.), more preferably 0.05 to 8 (pts.wt.), with respect to 100 (pts.wt.) of the binding resin. In the examples described later, 3.0 (pts.wt.) of hydrophobic silica R972 (with an average particle diameter of 16 (nm), commercially available from Nippon Aerosil Co., Ltd. located in Tokyo, Japan) and 0.3 (pts.wt.) of melamine resin particle EPOSTAR S (with an average particle diameter of 0.2 (μm), commercially available from Nippon Shokubai Co., Ltd. located in Osaka, Japan) were added as the external additives to 1 (kg) (100 (pts.wt.)) of the toner base particles, and the resultant was stirred by Henschel mixer to cause the external additives to be attached to the toner base particles. Such an external additive was added to each of the toners (the toners 30K, 30Y, 30M, 30C, and 30W) of the respective colors.

Each of the toners in the present example embodiment (the toners used in the examples described later) may be negatively charged (a negatively-charged toner) for each color. Since the toner base particles are common to the respective colors, thermophysical property is also common, and the following is observed in the measurement by a differential scanning calorimeter (EXSTAR 600 available from Seiko Instruments Inc. located in Chiba, Japan). When the toner is melted at first time (1st) at temperature Tg of 60.8° C., a weak absorption peak is observed at the temperature range from 0° C. to 70° C. When the toner is melted and the melted toner is thereafter cooled and melted again (2nd), the peak is not observed.

In the present example embodiment, although the detail is described later, the charge amounts of the toners of the respective colors have the following magnitude relationship. When the charge amount of the color toners (the toners 30K, 30Y, 30M, and 30C) is E1, and the charge amount of the white toner (the toner 30W) is E2, the ratio of the charge amounts E1 and E2 (the charge amount ratio: E2/E1) satisfies the following expression (1). In other words, the charge amount ratio (E2/E1) is a value within a range from 0.30 to 1.00.

$$0.30 \leq (E2/E1) \leq 1.00 \quad (1)$$

In the present example embodiment, the specific gravity of the toners of the respective colors may be as follows, for example. The density of each of the color toners (the toners 30K, 30Y, 30M, and 30C) may be within a range from 0.34 [g/cm$^3$] to 0.36 [g/cm$^3$], for example. The density of the write toner (the toner 30W) may be within a range from 0.55 [g/cm$^3$] to 0.60 [g/cm$^3$], for example. The "density" as used herein refers to an apparent density (mass per unit capacity including a volume of a vacant space), and may be measured with use of, for example, a powder tester (a PT-S type powder tester available from Hosokawa Micron Corporation located in Osaka, Japan). More specifically, first, a toner may be put into a sieve (mesh size: 710 μm) that is disposed above a cup whose capacity is 100 [cm$^3$], and the sieve may be vibrated to loosely fill the cup with the toner. Thereafter, the weight of the toner in the cup may be measured after the cup is filled up with the toner. The measured weight of the toner may be applied to the following expression (2) to calculate the above-described apparent density.

$$\text{Apparent density [g/cm}^3\text{]} = (\text{weight of toner [g]/capacity of cup [cm}^3\text{]}) \quad (2)$$

Of the toners of the respective colors mentioned above, the toners 30K, 30Y, 30M, and 30C each may correspond to a specific but non-limiting example of a "first developer" in one embodiment of the invention. Also, the toner 30W may correspond to a specific but non-limiting example of a "second developer" in one embodiment of the invention.

The image drum units 31K, 31Y, 31M, 31C, and 31W may have the same configuration as each other except that each unit forms a toner image (a developer image, or an image layer) with use of any of toners that are different in color from one another as mentioned above.

Figure 2:
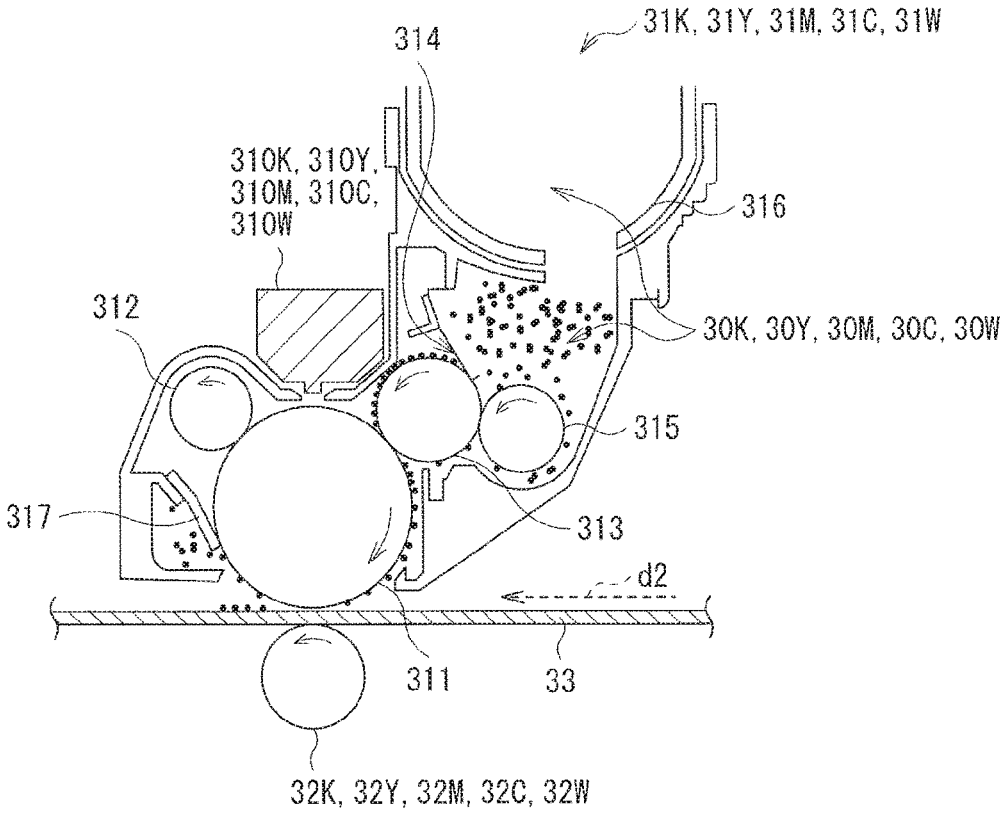
FIG. 2 is a schematic sectional diagram illustrating a detailed configuration example of each image dram unit illustrated in FIG. 1.

FIG. 2 is a sectional diagram schematically illustrating a detailed configuration example of one of the image drum units 31K, 31Y, 31M, 31C, and 31W. Each of the image drum units 31K, 31Y, 31M, 31C, and 31W may include a photosensitive drum (an image supporting member) 311, a charging roller (a charging member) 312, a developing roller (a developer supporting member) 313, a developing blade (a developer regulating member) 314, a feeding roller (a developer feeding member) 315, a toner cartridge (a developer container) 316, and a cleaning blade (a cleaning member) 317. Also, as illustrated in FIG. 1 and FIG. 2, exposure heads (exposure units) 310K, 310Y, 310M, 310C, and 310W may be disposed to respectively face the image drum units 31K, 31Y, 31M, 31C, and 31W.

The photosensitive drum 311 may be a member that supports an electrostatic latent image on a surface (a front layer) thereof, and may be configured of a photoreceptor (such as an organic photoreceptor). More specifically, the photosensitive drum 311 may include a conductive supporter and a photoconductive layer that covers an outer periphery (a surface) thereof. The conductive supporter may be configured of, for example, a metal pipe made of aluminum. The photoconductive layer may have a configuration in which, for example, a charge generation layer and a charge transportation layer are stacked in order. Such a photosensitive drum 311 may rotate at a predetermined circumferential velocity (in this example, rotates in a clockwise direction as illustrated by an arrow), as illustrated in FIG. 2.

The charging roller 312 may be a member (a charging member) that charges the surface (the front layer) of the photosensitive drum 311, and for example, may be disposed to come into contact with the surface (a circumferential surface) of the photosensitive drum 311. The charging roller 312 may include, for example, a metal shaft and a semi-conductive rubber layer (for example, a semi-conductive epichlorohydrin rubber layer) that covers an outer periphery (a surface) thereof. In this example, as illustrated by an arrow in FIG. 2, the charging roller 312 may rotate in a counterclockwise direction (may rotate in a direction opposite to the rotating direction of the photosensitive drum 311).

The developing roller 313 may be a member that supports, on a surface thereof, the toner (any of the toners 30K, 30Y, 30M, 30C, and 30W) adapted to develop an electrostatic latent image, and for example, may be disposed to be in contact with the surface (the circumferential surface) of the photosensitive drum 311. The developing roller 313 may include, for example, a metal shaft and a semi-conductive urethane rubber layer that covers an outer periphery (a surface) thereof. Such a developing roller 313 may rotate at a predetermined circumferential velocity (in this example, may rotate in a counterclockwise direction opposite to the rotating direction of the photosensitive drum 311, as illustrated by an arrow), as illustrated in FIG. 2.

The developing blade 314 may be a member (a toner regulating member) that comes into contact with the surface of the developing roller 313 to form a layer (a toner layer) made of the toner (any of the toners 30K, 30Y, 30M, 30C, and 30W) on the surface of the developing roller 313, and regulates (controls or adjusts) a thickness of the toner layer. The developing blade 314 may be, for example, a plate elastic member (a plate spring) made of stainless steel or any other material, and may be disposed such that a front end of the plate elastic member slightly comes into contact with the surface of the developing roller 313.

The feeding roller 315 may be a member (a feeding member) that feeds the toner (any of the toners 30K, 30Y, 30M, 30C, and 30W) to the developing roller 313, and may be so disposed as to come into contact with the surface (a circumferential surface) of the developing roller 313. The feeding roller 315 may include, for example, a metal shaft and a foamed silicone rubber layer that covers an outer periphery (a surface) thereof. In this example, the feeding roller 315 may rotate in a counterclockwise direction (may rotate in a direction same as the rotating direction of the developing roller 313) as illustrated in FIG. 2.

The toner cartridge 316 may be a container that retains (contains) any of the toners (any of the toners 30K, 30Y, 30M, 30C, and 30W) of the respective colors.

The cleaning blade 317 may be a member that scrapes the toner (any of the toners 30K, 30Y, 30M, 30C, and 30W) remaining on the surface (the front layer) of the photosensitive drum 311 and thereby cleans the surface of the photosensitive drum 311. For example, the cleaning blade 317 may be so disposed as to be in counter contact with the surface of the photosensitive drum 311 (to protrude oppositely to the rotating direction of the photosensitive drum 311). Such a cleaning blade 317 may be configured of, for example, an elastic body such as polyurethane rubber.

Each of the exposure heads 310K, 310Y, 310M, 310C, and 310W may apply irradiation light to the surface of the corresponding photosensitive drum 311 to perform exposure and may thereby form an electrostatic latent image on the surface (the front layer) of the corresponding photosensitive drum 311. Each of such exposure heads 310K, 310Y, 310M, 310C, and 310W may include, for example, a plurality of light sources each emitting the irradiation light, and a lens array that focuses the irradiation light onto the surface of the corresponding photosensitive drum 311. Examples of the light source may include a light emitting diode (LED) and a laser device.

As illustrated in FIG. 1, the intermediate transfer belt unit mentioned above may be a belt unit to which the toner images of the respective colors formed by the image drum units 31K, 31Y, 31M, 31C, and 31W are transferred on the basis of a primary transfer (transferred intermediately). The toner images of the respective colors that have been thus-transferred on the basis of the primary transfer may be transferred, on the basis of a secondary transfer, from the intermediate transfer belt unit to the print medium 9 conveyed along the conveying direction d1 as described later.

As mentioned above, the intermediate transfer belt unit may include the five primary transfer rollers 32K, 32Y, 32M, 32C, and 32W, the intermediate transfer belt 33, the driving roller 34*a*, the driven roller 34*b*, the secondary transfer counter roller 35*b*, the cleaning blade 361, and the waste toner tank 362.

The primary transfer rollers 32K, 32Y, 32M, 32C, and 32W may be members that each electrostatically transfers (transfers on the basis of the primary transfer), to the intermediate transfer belt 33, the toner images of the respective colors formed in the respective image drum units 31K, 31Y, 31M, 31C, and 31W. As illustrated in FIG. 1 and FIG. 2, these primary transfer rollers 32K, 32Y, 32M, 32C, and 32W may be disposed to be respectively face the image drum units 31K, 31Y, 31M, 31C, and 31W with the intermediate transfer belt 33 in between.

As mentioned above, the intermediate transfer belt 33 may be a belt having a surface to which the toner images of the respective colors formed by the respective image drum units 31K, 31Y, 31M, 31C, and 31W are transferred on the basis of the primary transfer. In other words, such toner images of the respective colors may be temporarily supported on the surface of the intermediate transfer belt 33. As illustrated in FIG. 1, the intermediate transfer belt 33 may be suspended by a plurality of rollers including the driving roller 34*a* and the driven roller 34*b*. Also, the intermediate transfer belt 33 may be driven by the driving roller 34*a* and the driven roller 34*b*, to rotationally move along the conveying direction d2 illustrated in FIG. 1 and FIG. 2. The intermediate transfer belt 33 and the photosensitive drums 311 in the respective image drum units 31K, 31Y, 31M, 31C, and 31W may come into contact with each other, thereby forming primary transfer nip parts. The intermediate transfer belt 33 may be configured of, for example, a seamless, endless high-resistance semi-conductive plastic film. The toner images of the respective colors that have been thus-transferred on the basis of the primary transfer to the surface of the intermediate transfer belt 33 may be transferred on the basis of the secondary transfer to the print medium 9 as described later. The intermediate transfer belt 33 in the present example embodiment may correspond to a specific but non-limiting example of a "transfer object" in one embodiment of the invention.

The above-described secondary transfer roller 35*a* may be a member that electrostatically transfers (transfers on the basis of the secondary transfer), to the print medium 9, the toner images of the respective colors that have been transferred on the basis of the primary transfer to the intermediate transfer belt 33. As illustrated in FIG. 1, the secondary transfer counter roller 35*b* may be a roller disposed to face the secondary transfer roller 35*a* with the intermediate transfer belt 33 in between. Such an arrangement causes the intermediate transfer belt 33 to be pressed against the secondary transfer counter roller 35*b* by the secondary transfer roller 35*a*. The secondary transfer roller 35*a* and the intermediate transfer belt 33 may come into contact with each other, thereby forming a secondary transfer nip part. The secondary transfer roller 35*a* and the secondary transfer counter roller 35*b* may be supplied with respective predetermined transfer voltages described later upon the above-described secondary transfer.

The secondary transfer roller 35*a*, the secondary transfer counter roller 35*b*, and the above-described primary transfer rollers 32K, 32Y, 32M, 32C, and 32W in the present example embodiment may correspond to a specific but non-limiting example of a "transfer section" in one embodiment of the invention.

The cleaning blade 361 may be a member that scrapes the toners (secondary transfer residual toners) remaining on the intermediate transfer belt 33 to thereby clean the intermediate transfer belt 33. Such a cleaning blade 361 may be configured of, for example, a flexible rubber member or a plastic member.

The waste toner tank 362 may be a container that contains the toners (waste toner) scraped by the cleaning blade 361 in the above-described manner.

[Fixing Unit 4, Etc.]

The fixing unit 4 may apply heat and pressure to the toners (the toner image) on the print medium 9 conveyed along the conveying direction d1 after the above-described secondary transfer is performed, to thereby fix the toners on the conveyed print medium 9. As illustrated in FIG. 1, the fixing unit 4 may include a heat roller 41, a pressure applying roller 42, a heater 43, and a thermistor 44. The fixing unit 4 may correspond to a specific but non-limiting example of a "fixing section" in one embodiment of the invention.

The heat roller 41 may be a member (a heating roller) that applies the heat to the toners on the print medium 9. The heater 43 configured of, for example, a halogen lamp may be disposed inside the heat roller 41. The pressure applying roller 42 may be a member that is so disposed as to form a pressure contact part between the pressure applying roller 42 and the heat roller 41 and applies the pressure to the toners on the print medium 9. As illustrated in FIG. 1, the thermistor 44 may be a device that is disposed near a surface of the heat roller 41 and measures a surface temperature of the heat roller 41.

As illustrated in FIG. 1, the secondary transfer discharge sensor 21 may be disposed between the secondary transfer roller 35*a* and the fixing unit 4 along the conveying direction d1. The secondary transfer discharge sensor 21 may be a sensor that monitors factors including wrapping of the print medium 9 to the secondary transfer roller 35*a* and separation of the print medium 9 from the intermediate transfer belt 3.

As illustrated in FIG. 1, the fixing discharge sensor 22 may be disposed between the fixing unit 4 and the guide 5 along the conveying direction d1. The fixing discharge sensor 22 may be a sensor that monitors factors including jam occurred in the fixing unit 4 and wrapping of the print medium 9 to the heat roller 41.

The guide 5 may be a guiding member that discharges, toward outside of the image forming apparatus 1 (e.g., a stacker 10*a* at an upper part of the housing illustrated in FIG. 1), the print medium 9 that has been conveyed along the conveying direction d1.

As illustrated in FIG. 1, the environment sensor 6 may be a sensor that is disposed at a predetermined position in the housing 10 and measures environmental state such as temperature and humidity. For example, the abutting state and the separating state of the respective image drum units 31K, 31Y, 31M, 31C, and 31W to the intermediate transfer belt 33 may be determined before the start of the printing operation or any other timing, on the basis of the environmental state measured by the environment sensor 6 in the above-described manner.

[Action and Effects]

[A. Basic Operation of Entire Image Forming Apparatus 1]

In the image forming apparatus 1, the image may be formed on the print medium 9 (the printing operation is performed) in the following manner. In other words, when print data is supplied to a control section of the image forming apparatus 1 from an external apparatus such as a PC through a communication line, etc., the control section may execute the printing processing to cause the respective members in the image forming apparatus 1 to perform the following operation, on the basis of the print data.

As illustrated in FIG. 1, the print medium 9 contained in the housing 10 may be first fed by the feeding mechanism 11, and the print medium 9 may thereafter be conveyed along the conveying direction d1 (the conveying path). Thereafter, the toner images of the respective colors may be formed by the image forming mechanism 3 on the thus-conveyed print medium 9.

More specifically, first, the toner images of the respective colors may be formed through the electro-photography process by the image drum units 31K, 31Y, 31M, 31C, and 31W in the image forming mechanism 3, on the basis of the above-described print data. Thereafter, the toner images of the respective colors thus formed may be transferred sequentially, on the basis of the primary transfer, to the intermediate transfer belt 33 along the conveying direction d2. Thereafter, the toner images (the toner images transferred on the basis of the primary transfer) on the intermediate transfer belt 33 may be transferred, on the basis of the secondary transfer, by the secondary transfer roller 35*a* and the secondary transfer counter roller 35*b* to the conveyed print medium 9.

The voltages to be applied to the respective members by various kinds of power supplies upon formation and transfer of the toner images of the respective colors may be as follows, for example. The voltage to be applied to the surface of the photosensitive drum 311 may be, for example, −500 V, and the voltage to be applied to the charging roller 312 may be, for example, −1000 V. The voltage of the electrostatic latent image formed on the surface of the photosensitive drum 311 by the exposure heads 310K, 310Y, 310M, 310C, and 310W may be, for example, −50 V. The voltage to be applied to the feeding roller 315 may be, for example, −300 V, and the voltage to be applied to the developing roller 313 may be, for example, −200 V. The voltage to be applied to each of the primary transfer rollers 32K, 32Y, 32M, 32C, and 32W (the transfer voltage in the primary transfer) may be, for example, +1500 V, and the voltage to be applied to the secondary transfer roller 35*a* (the transfer voltage in the secondary transfer) may be, for example, 0 V. The voltage to be applied to the secondary transfer counter roller 35*b* may be, for example, −2000 V.

Figure 3:
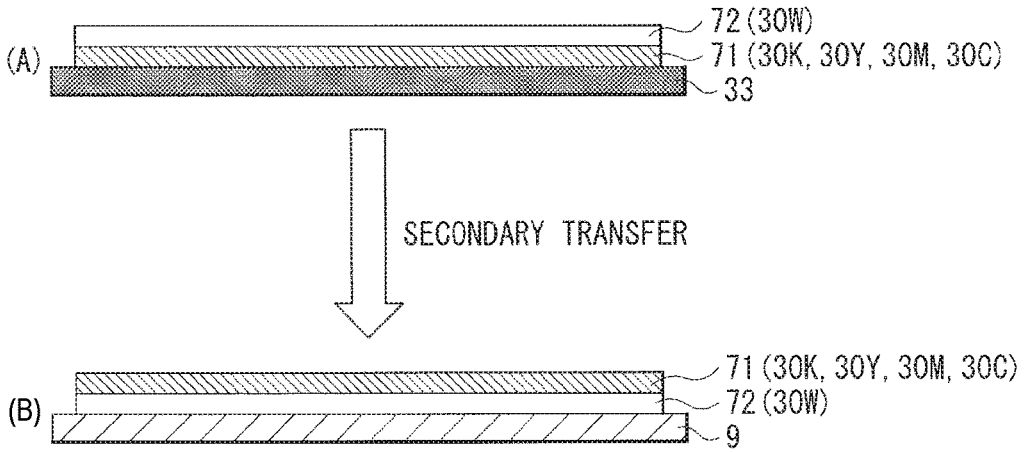
FIG. 3 is a schematic sectional diagram illustrating a transfer state of an image layer and an underlayer in FIG. 1.

More specifically, transfer of the toner images (the primary transfer and the secondary transfer) may be performed in a manner illustrated in FIG. 3, for example.

As illustrated in (A) of FIG. 3, first, an image layer 71 (a layer of the toner images of the toners 30K, 30Y, 30M, and 30C) formed by the image drum units 31K, 31Y, 31M, and 31C and an underlayer 72 (a white layer of the toner 30W) formed by the image drum unit 31W may be transferred, on the basis of the primary transfer, sequentially in this order to the intermediate transfer belt 33.

Thereafter, for example, as illustrated in (B) of FIG. 3, the image layer 71 and the underlayer 72 that have been transferred on the basis of the primary transfer to the intermediate transfer belt 33 may be transferred on the basis of the secondary transfer to the print medium 9. At this time, the stacked order of the image layer 71 and the underlayer 72 is reversed, meaning that the underlayer 72 and the image layer 71 are eventually formed in this order on the print medium 9. In other words, the underlayer 72 may be formed between the print medium 9 and the image layer 71 (as a layer below the image layer 71), and may serve as a layer having an auxiliary function (an auxiliary layer) upon formation of the image layer 71. Also, in the present example embodiment, the underlayer 72 may be a monochrome layer (may be a white layer) having white color. The underlayer 72 may correspond to a specific but non-limiting example of each of an "auxiliary layer", a "monochrome layer", and a "white layer" in one embodiment of the invention.

A favorable range of the attachment amount of the color toners (the toners 30K, 30Y, 30M, and 30C) transferred to the intermediate transfer belt 33 upon the above-described primary transfer may be, for example, a range from 0.4 [mg/cm$^2$] to 0.6 [mg/cm$^2$], and more preferably, for example, from 0.4 [mg/cm$^2$] to 0.5 [mg/cm$^2$]. A favorable range of the attachment amount of the white toner (the toner 30W) at this time may be, for example, from 0.7 [mg/cm$^2$] to 1.1 [mg/cm$^2$], and more preferably, for example, from 0.8 [mg/cm$^2$] to 1.0 [mg/cm$^2$].

Thereafter, the fixing unit 4 may apply the heat and the pressure to the toner images (the image layer 71 and the underlayer 72) on the print medium 9 conveyed from the secondary transfer roller 35*a* to thereby fix the toner images on the print medium 9. In other words, a collective fixing operation may be performed on the image layer 71 and the underlayer 72 that have been transferred on the basis of the secondary transfer to the print medium 9. Thus, printing by a so-called "1-Pass" method (1-Pass printing), i.e., a printing operation in which the print medium 9 is passed once, may be performed in this way. The print medium 9 having been subjected to the fixing operation in this way may pass through the guide 5 to be discharged to the outside of the image forming apparatus 1. This may complete the image forming operation by the image forming apparatus 1.

[B. Occurrence of Mixing Phenomenon]

In general, in the image forming operation, there is a case in which mixing phenomenon described below may occur on the print medium 9 upon the above-described secondary transfer, and print image quality may be impaired accordingly. The mixing phenomenon as used herein refers to a phenomenon in which the above-described image layer 71 (the color toners, or the toners 30K, 30Y, 30M, and 30C) and the above-described underlayer 72 (the white toner, or the toner 30W) are mixed on the print medium 9 in the secondary transfer. When such mixing phenomenon occurs, color tone of the image layer 71 on the print medium 9 becomes whitish to impair color concentration, which results in defective printing. The occurrence principle of such mixing phenomenon is first described in detail below.

Figure 4:
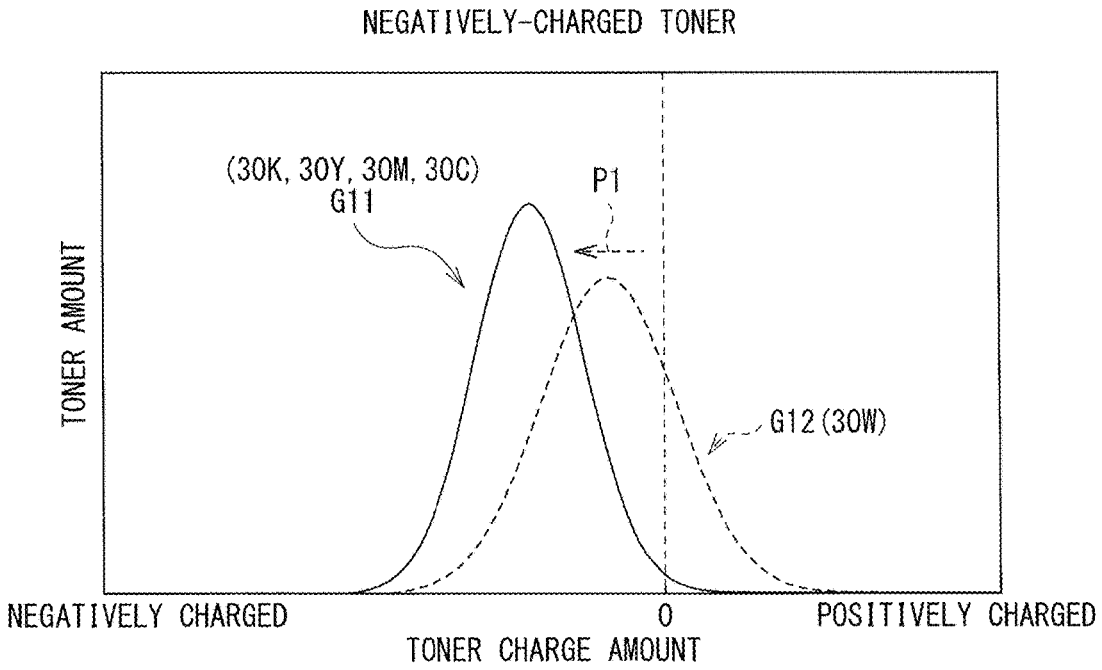
FIG. 4 is a schematic diagram illustrating an example of common charge amount distribution of a negatively-charged toner.

FIG. 4 schematically illustrates an example of charge amount distribution of common toner in a case where each of the toners 30K, 30Y, 30M, 30C, and 30W is a negatively-charged toner. The following is found from FIG. 4 when the charge amount distribution of the color toners (the toners 30K, 30Y, 30M, and 30C) forming the image layer 71 is compared with the charge amount distribution of the white toner (the toner 30W) forming the underlayer 72. In the toners 30K, 30Y, 30M, and 30C (highly-charged toners), a rate of the positive polarity toner is relatively low and a rate of the negative polarity toner is relatively high, as compared with the toner 30W (lowly-charged toner). Conversely, in the toner 30W, the rate of the positive polarity toner is relatively high and the rate of the negative polarity toner is relatively low, as compared with the toners 30K, 30Y, 30M, and 30C.

As mentioned above, the secondary transfer roller 35*a* and the secondary transfer counter roller 35*b* may be supplied with the respective transfer voltages different in polarity from each other upon the above-described secondary transfer. More specifically, in the case where each toner is the negatively-charged toner as with the present example embodiment, the secondary transfer roller 35*a* may be supplied with the voltage of positive (+) polarity (for example, 0 V), and the secondary transfer counter roller 35*b* may be supplied with the voltage of negative (−) polarity (for example, −2000 V).

Figure 5:
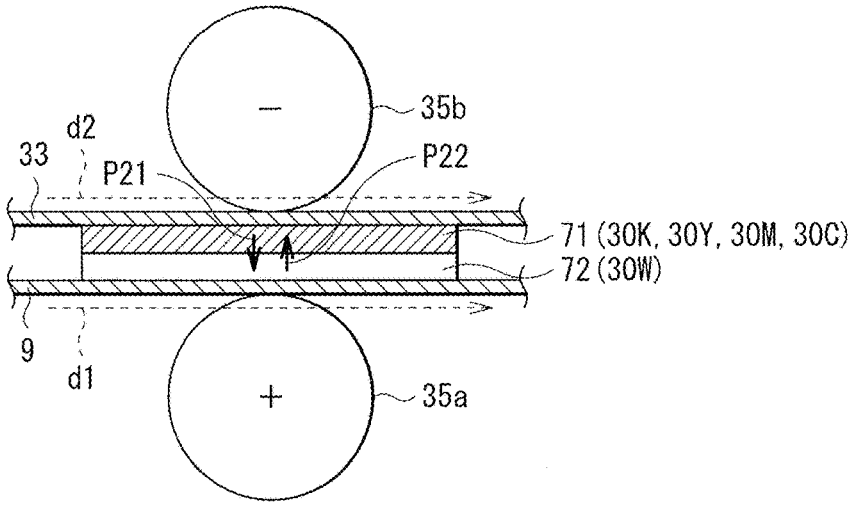
FIG. 5 is a schematic sectional diagram illustrating occurrence principle of mixing phenomenon in a case of the negatively-charged toner illustrated in FIG. 4.

Accordingly, for example, as schematically illustrated in FIG. 5, out of the toners of the respective colors on the intermediate transfer belt 33, the toner 30W forming the underlayer 72 is drawn, at a high rate, to the secondary transfer counter roller 35*b* that is supplied with the voltage of negative polarity (refer to an arrow P22) upon the secondary transfer. In contrast, out of the toners of the respective colors on the intermediate transfer belt 33, the toners 30K, 30Y, 30M, and 30C forming the image layer 71 are drawn, at a high rate, to the secondary transfer roller 35*a* that is supplied with the voltage of positive polarity (refer to an arrow P21). As a result, as can be seen from the directions of the arrows P21 and P22, the color toners (the toners 30K, 30Y, 30M, and 30C) forming the image layer 71 and the white toner (the toner 30W) forming the underlayer 72 tend to be easily mixed with each other on the print medium 9 upon the secondary transfer.

In the common image forming apparatus, such mixing phenomenon easily occurs as mentioned above, which may cause degradation in print image quality.

[C. Action and Effects by Charged Amount Ratio of Toners]

The image forming apparatus 1 according to the present example embodiment alleviates the above-described concern (degradation in print image quality caused by occurrence of the mixing phenomenon) by the method described below.

The toners 30K, 30Y, 30M, 30C, and 30W of the present example embodiment satisfy the above-described expression (1). In other words, when the charge amount of the color toners (the toners 30K, 30Y, 30M, and 30C) is E1 and the charge amount of the white toner (the toner 30W) is E2, the ratio of the charge amounts E1 and E2 (the charge amount ratio: E2/E1) is a value within a range from 0.30 to 1.00.

This means that, for example, as illustrated by an arrow P1 in FIG. 4 mentioned above, the charge amount E2 of the white toner (the toner 30W) is relatively increased to be brought close to the charge amount E1 of the color toners (the toners 30K, 30Y, 30M, and 30C). In other words, the rate of the positive polarity toner in the toner 30W is relatively decreased while the rate of the negative polarity toner in the toner 30W is relatively increased.

To increase the charge amount E2 of the white toner (the toner 30W) as mentioned above, for example, an additive amount of the above-described charge control agent may be varied. Note that, taking into consideration the above-described occurrence principle, it is conceivable that the mixing phenomenon does not occur when the charge amount E1 is equal to the charge amount E2 (E1=E2). Thus, the maximum value of the charge amount ratio (E2/E1) is assumed to be 1.00.

Figure 6:
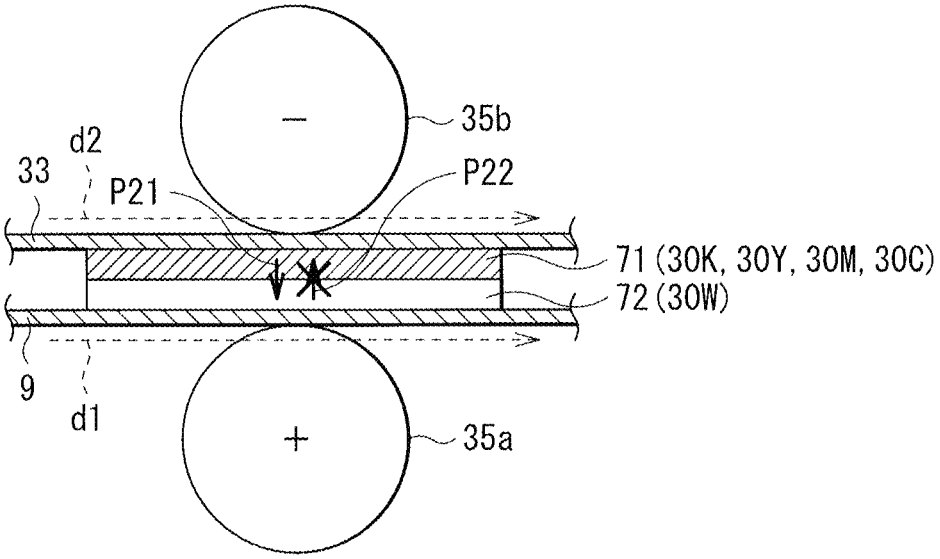
FIG. 6 is a schematic sectional diagram illustrating action of suppressing the mixing phenomenon in the example embodiment.

In the present example embodiment, since the rate of the positive polarity toner is decreased in the toner 30W that forms the underlayer 72 on the intermediate transfer belt 33, the toner 30W is less drawn to (desirably, not drawn to) the secondary transfer counter roller 35*b* that is supplied with the voltage of negative polarity upon the secondary transfer, for example, as schematically illustrated in FIG. 6 (refer to a symbol "x" in the arrow P22). As a result, the color toners (the toners 30K, 30Y, 30M, and 30C) that form the image layer 71 and the white toner (the toner 30W) forming the underlayer 72 are less mixed with each other on the print medium 9 upon the secondary transfer, making it possible to suppress the occurrence of the mixing phenomenon.

The present example embodiment satisfies the above-described expression (1), making it possible to suppress the occurrence of the mixing phenomenon on the print medium 9 upon the secondary transfer. Hence, it is possible to suppress degradation of color tone of the image on the print medium 9, and to improve print image quality accordingly.

EXAMPLES

Specific examples (examples 1 and 2) of the present example embodiment are described in detail below while making a comparison with a reference example and a comparative example. It should be understood that the examples described below are illustrative, and should not be construed as being limiting in any way.

Comparative Example

Each of the image layer 71 and the underlayer 72 stacked in order illustrated in, for example, FIG. 3 were formed by the above-described 1-Pass printing of the intermediate transfer system by the image drum units 31K, 31Y, 31M, 31C, and 31W arranged in this order, illustrated in FIG. 1. The cyan toner (the toner 30C) was used below as the representative of the color toners (the toners 30K, 30Y, 30M, and 30C).

First, adjustment of 100% solid concentration (the print density of 100%) was performed on each of the cyan toner and the above-described white toner A serving as the white toner (the toner 30W). The adjustment was performed on the cyan toner in the following manner. A 100% solid image of the cyan toner was printed on excellent white A4 paper (basis weight: 105 g/m$^2$) commercially available from Oki Data Corporation located in Tokyo, Japan, the concentration at that time was measured by an x-rite spectral densitometer (available from X-Rite Inc. located in Michigan, U.S.), and a layer thickness of the cyan toner (the thickness of the image layer 71) was adjusted such that the concentration becomes 1.40. The layer thickness of the color toner at this time was 0.40 mg/cm$^2$. In contrast, as for the white toner A, a 100% solid image of the white toner A was printed on blue A4 paper (basis weight: 79.1 g/m$^2$) commercially available from Hokuetsu Kishu Paper Co., Ltd. located in Tokyo, Japan, the color phase at that time was measured by a spectral densitometer "X-Rite 528" available from X-Rite Inc., and a layer thickness of the white toner A (the thickness of the underlayer 72) was adjusted such that the value of L* becomes 83. The layer thickness of the white toner A at this time was 0.90 mg/cm$^2$.

Thereafter, the charge amount of each toner (the cyan toner and the white toner A mentioned above) on the photosensitive drum 311 was measured by a charge amount measurement apparatus (Model 212HS Charge-to-Mass Ratio System available from TREK Japan located in Tokyo, Japan). More specifically, the charge amount on the photosensitive drum 311 was measured after the power supply was instantaneously interrupted during the image formation. The image formation involved the use of the toners of 100% solid concentration. The toners each had undergone the above-described adjustment. At this time, the charge amount of the cyan toner (corresponding to the above-described charge amount E1) on the photosensitive drum 311 was −13.6 μC/g, and the charge amount of the white toner A (corresponding to the above-described charge amount E2) on the photosensitive drum 311 was −2.7 μC/g. Therefore, in the comparative example, the above-described charge amount ratio (E2/E1) was 0.20. Thus, in the comparative example, the value of the charge amount ratio (E2/E1) was out of the range of the above-described expression (1) (the expression (1) was not satisfied in the comparative example).

Example 1

The process and the measurement similar to those of the comparative example were performed with use of the above-described cyan toner and the above-described white toner B serving as the white toner, and the evaluation similar to that of the comparative example was performed. At this time, the charge amount of the cyan toner (corresponding to the charge amount E1) on the photosensitive drum 311 was −13.6 μC/g, and the charge amount of the white toner B (corresponding to the charge amount E2) on the photosensitive drum 311 was −4.2 μC/g. Therefore, the charge amount ratio (E2/E1) was 0.30 in the example 1. Thus, in the example 1, the value of the charge amount ratio (E2/E1) was within the range of the above-described expression (1) (the expression (1) was satisfied in the example 1).

Example 2

The process and the measurement similar to those of the comparative example were performed with use of the above-described cyan toner and the above-described white toner C serving as the white toner, and the evaluation similar to that of the comparative example was performed. At this time, the charge amount of the cyan toner (corresponding to the charge amount E1) on the photosensitive drum 311 was −13.6 μC/g, and the charge amount of the white toner C (corresponding to the charge amount E2) on the photosensitive drum 311 was −7.5 μC/g. Therefore, the charge amount ratio (E2/E1) was 0.55 in the example 2. Thus, also in the example 2, the value of the charge amount ratio (E2/E1) was within the range of the above-described expression (1) (the expression (1) was satisfied also in the example 2).

Reference Example

The evaluation similar to that of the comparative example was performed with use of the above-described cyan toner and the above-described white toner A serving as the white toner, as with the comparative example. In the reference example, however, 2-Pass printing of the intermediate transfer system was performed, unlike the comparative example and the examples 1 and 2. The 2-Pass printing refers to the printing operation in which the print medium 9 is passed twice (the printing of a so-called "2-Pass" method). In the reference example (the 2-Pass printing), the underlayer 72 was subjected to passing to perform the fixing operation on the underlayer 72 once, following which the image layer 71 formed on the fixed underlayer 72 was subjected to passing to perform the fixing operation again, meaning that the degradation of print image quality caused by the above-described mixing phenomenon was prevented from occurring.

FIG. 7 is a table illustrating summary of printing results according to the reference example, the comparative example, and the examples 1 and 2 mentioned above. More specifically, the table illustrates the printing method, the charge amount E1 of the color toner (the cyan toner in this case), the charge amount E2 of the white toner (any of the white toner A, B, and C in this case), the charge amount ratio (E2/E1), a picture example printed on the print medium 9 as the printing result, and evaluations based on the visual determination and the concentration determination with respect to the printing result, for each of the reference example, the comparative example, and the examples 1 and 2.

The visual determination on the printing results was evaluated in the following three grades (evaluations A, B, and C).

Evaluation A: almost no void occurred in the image layer 71.

Evaluation B: few voids occurred in the image layer 71 at ignorable level.

Evaluation C: the level of the void occurred in the image layer 71 was large (mixing phenomenon occurred).

The concentration determination on the printing results was evaluated in the following two grades (evaluations A and B).

Evaluation A: the concentration of the image layer 71 was equal to or greater than the concentration of the reference example.

Evaluation B: the concentration of the image layer 71 was less than the concentration of the reference example (mixing phenomenon occurred).

[Evaluation]

In the comparative example, as illustrated in FIG. 7, the evaluation result of the visual determination was C and the evaluation result of the concentration determination was B, and defective printing (degradation of image quality) caused by the above-described mixing phenomenon was visually confirmed. This is because the white toner A used in the comparative example was small in the value of the charge amount E2, and the charge amount ratio (E2/E1) was accordingly small and out of the range of the above-described expression (1) (the expression (1) was not satisfied).

In contrast, in each of the examples 1 and 2, an improvement in defective printing (degradation of image quality) caused by the mixing phenomenon was confirmed as compared with the above-described comparative example. More specifically, the evaluation result of the visual determination was B and the evaluation result of the concentration determination was A in the example 1. Also, the evaluation result of the visual determination was A and the evaluation result of the concentration determination was A in the example 2. This is because the value of the charge amount E2 of each of the white toners B and C respectively used in the examples 1 and 2 was larger than that of the white toner A used in the comparative example, and the value of the charge amount ratio (E2/E1) accordingly became larger and was within the range of the above-described expression (1) (the expression (1) was satisfied). In other words, it was confirmed that, in the examples 1 and 2, satisfying the expression (1) makes it possible to suppress the occurrence of the mixing phenomenon as compared with the comparative example, and thereby to suppress the degradation of image quality caused by the mixing phenomenon. In addition, in the example 2 in particular, the value of the charge amount ratio (E2/E1) was larger because the value of the charge amount E2 was larger than that of the example 1. As a result, it was confirmed that degradation of image quality caused by the mixing phenomenon was further suppressed in the example 2. Accordingly, the value of the charge amount ratio (E2/E1) may be desirably close to 1.00 that is the upper limit of the expression (1), as much as possible (as large as possible).

2. Modifications

Modifications (modifications 1 and 2) of the above-described embodiment are now described. In the following modifications, like numerals are used to designate substantially like components of the example embodiment, and the description thereof is appropriately omitted.

Modification 1

First, a modification 1 is described. In the above-described embodiment, each of the toners 30K, 30Y, 30M, 30C, and 30W is the negatively-charged toner. In contrast, in the modification 1, each of the toners 30K, 30Y, 30M, 30C, and 30W is a positively-charged toner.

Figure 8:
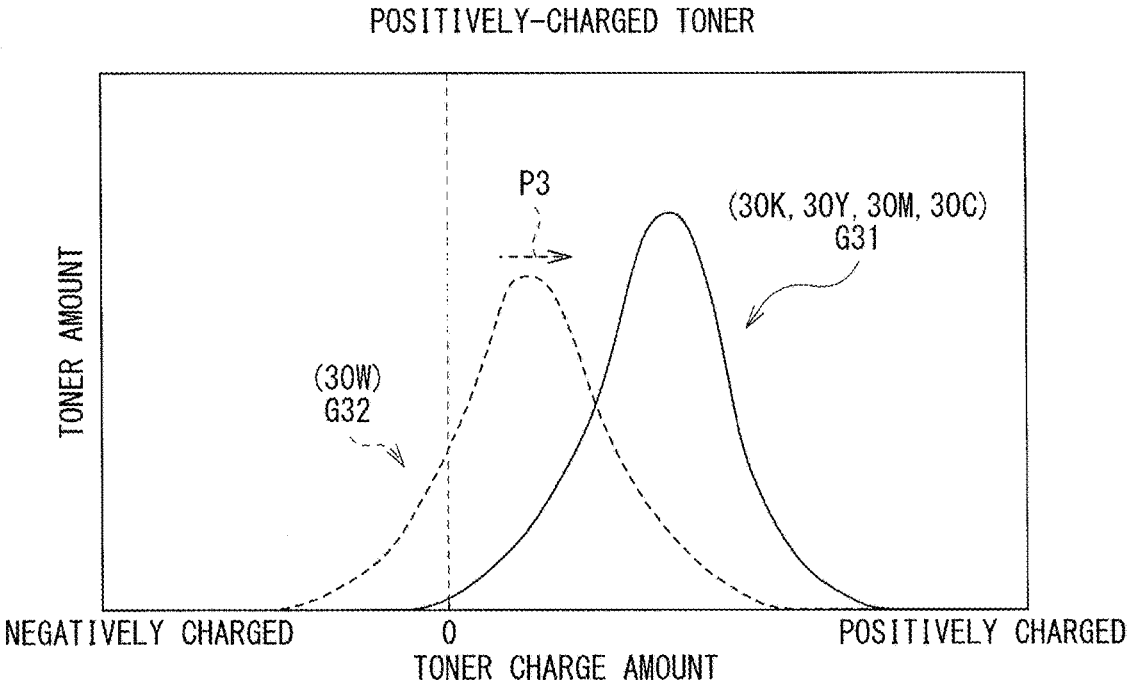
FIG. 8 is a schematic diagram illustrating an example of charge amount distribution of a common positively-charged toner according to a modification 1.

FIG. 8 schematically illustrates an example of charge amount distribution of common toner in the case where each of the toners 30K, 30Y, 30M, 30C, and 30W is a positively-charged toner. The following can be appreciated from FIG. 8 upon comparing the charge amount distribution of the color toners (the toners 30K, 30Y, 30M, and 30C) that form the image layer 71 with the charge amount distribution of the white toner (the toner 30W) that forms the underlayer 72. In the toners 30K, 30Y, 30M, and 30C (the highly-charged toners), the rate of the positive polarity toner is relatively high and the rate of the negative polarity toner is relatively low, as compared with the toner 30W (the low-charged toner). Conversely, in the white toner 30W, the rate of the positive polarity toner is relatively low and the rate of the negative polarity toner is relatively high, as compared with the toners 30K, 30Y, 30M, and 30C.

In addition, also in the modification 1, the secondary transfer roller 35*a* and the secondary transfer counter roller 35*b* may be supplied with respective predetermined transfer voltages that are different in polarity from each other upon the secondary transfer. In the modification 1, however, the secondary transfer roller 35*a* may be supplied with a voltage of negative (−) polarity (for example, −2000 V), and the secondary transfer counter roller 35*b* is supplied with a voltage of positive (+) polarity (for example, 0 V), contrary to the above-described embodiment.

Figure 9:
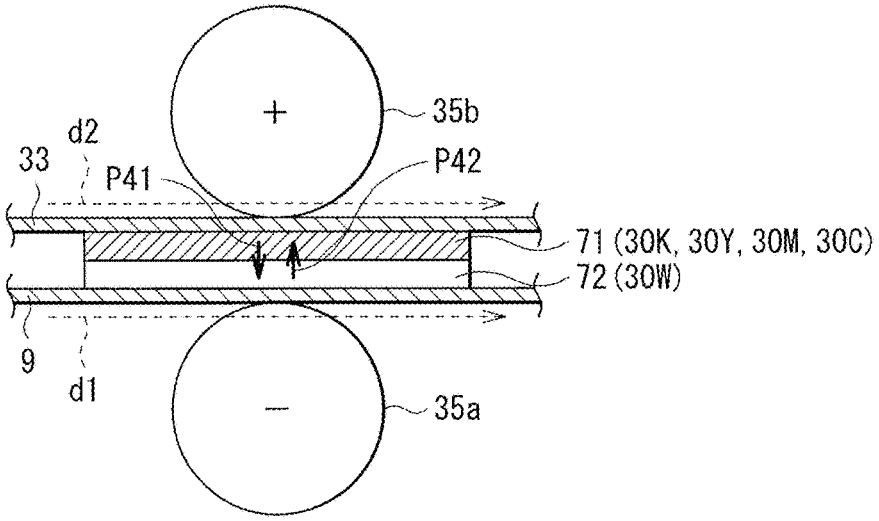
FIG. 9 is a schematic sectional diagram illustrating occurrence principle of the mixing phenomenon in a case of the positively-charged toner illustrated in FIG. 8.

Accordingly, also in the modification 1, as schematically illustrated in FIG. 9, for example, there may be a case where the mixing phenomenon occurs by the occurrence principle similar to that described in the foregoing example embodiment. In other words, out of the toners of the respective colors on the intermediate transfer belt 33, the toner 30W that forms the underlayer 72 is drawn, at a high rate, to the secondary transfer counter roller 35*b* that is supplied with the voltage of positive polarity (refer to an arrow P42) upon the secondary transfer. In contrast, out of the toners of the respective colors on the intermediate transfer belt 33, the toners 30K, 30Y, 30M, and 30C that form the image layer 71 are drawn, at a high rate, to the secondary transfer roller 35*a* that is supplied with the voltage of negative polarity (refer to an arrow P41). As a result, as can be seen from the directions of these arrows P41 and P42, the color toners (the toners 30K, 30Y, 30M, and 30C) forming the image layer 71 and the white toner (the toner 30W) tend to be easily mixed with each other on the print medium 9 upon the secondary transfer.

Thus, each of the toners 30K, 30Y, 30M, and 30C in the modification 1 also satisfies the above-described expression (1). In other words, the ratio (the charge amount ratio: E2/E1) of the charge amount E1 of the color toners (the toners 30K, 30Y, 30M, and 30C) and the charge amount E2 of the white toner (the toner 30W) is the value within the range from 0.30 to 1.00.

This means that, for example, as illustrated by an arrow P3 in FIG. 8 mentioned above, the charge amount E2 of the white toner (the toner 30W) is relatively increased to be brought close to the charge amount E1 of the color toners (the toners 30K, 30Y, 30M, and 30C). In other words, the rate of the positive polarity toner in the toner 30W is relatively increased while the rate of the negative polarity toner in the toner 30W is relatively decreased.

Figure 10:
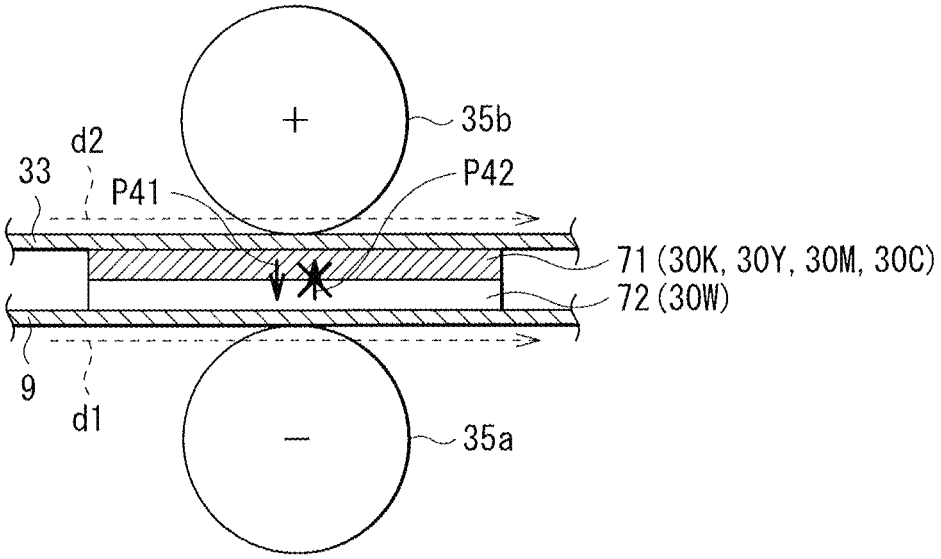
FIG. 10 is a schematic sectional diagram illustrating action of suppressing the mixing phenomenon in the modification 1.

In the modification 1, since the rate of the negative polarity toner is decreased in the toner 30W that forms the underlayer 72 on the intermediate transfer belt 33, the toner 30W is less drawn to (desirably, not drawn to) the secondary transfer counter roller 35*b* that is supplied with the voltage of positive polarity upon the secondary transfer, for example, as schematically illustrated in FIG. 10 (refer to a symbol "x" in the arrow P42). As a result, the color toners (the toners 30K, 30Y, 30M, and 30C) that form the image layer 71 and the white toner (the toner 30W) that forms the underlayer 72 are less mixed with each other on the print medium 9 upon the secondary transfer, making it possible to suppress the occurrence of the mixing phenomenon.

The modification 1 also satisfies the above-described expression (1), making it possible to suppress the occurrence of the mixing phenomenon on the print medium 9 upon the secondary transfer. Hence, it is possible to suppress the degradation of color tone of the image on the print medium 9, and to improve print image quality accordingly.

Modification 2

Next, a modification 2 is described. The foregoing example embodiment and the modification 1 have been described with reference to an example in which the image forming apparatus employs the so-called intermediate transfer system. In contrast, the modification 2 is described with reference to an application example in which an image forming apparatus employs a so-called direct transfer system that directly transfer a toner image to the print medium 9 without the above-described intermediate transfer belt unit. The intermediate transfer belt 33 in each of the example embodiment and the modification 1 may correspond to a specific but non-limiting example of the "transfer object" in one embodiment of the invention, whereas the print medium 9 itself in the modification 2 described below may correspond to a specific but non-limiting example of the "transfer object" in one embodiment of the invention.

Configuration Example

Figure 11:
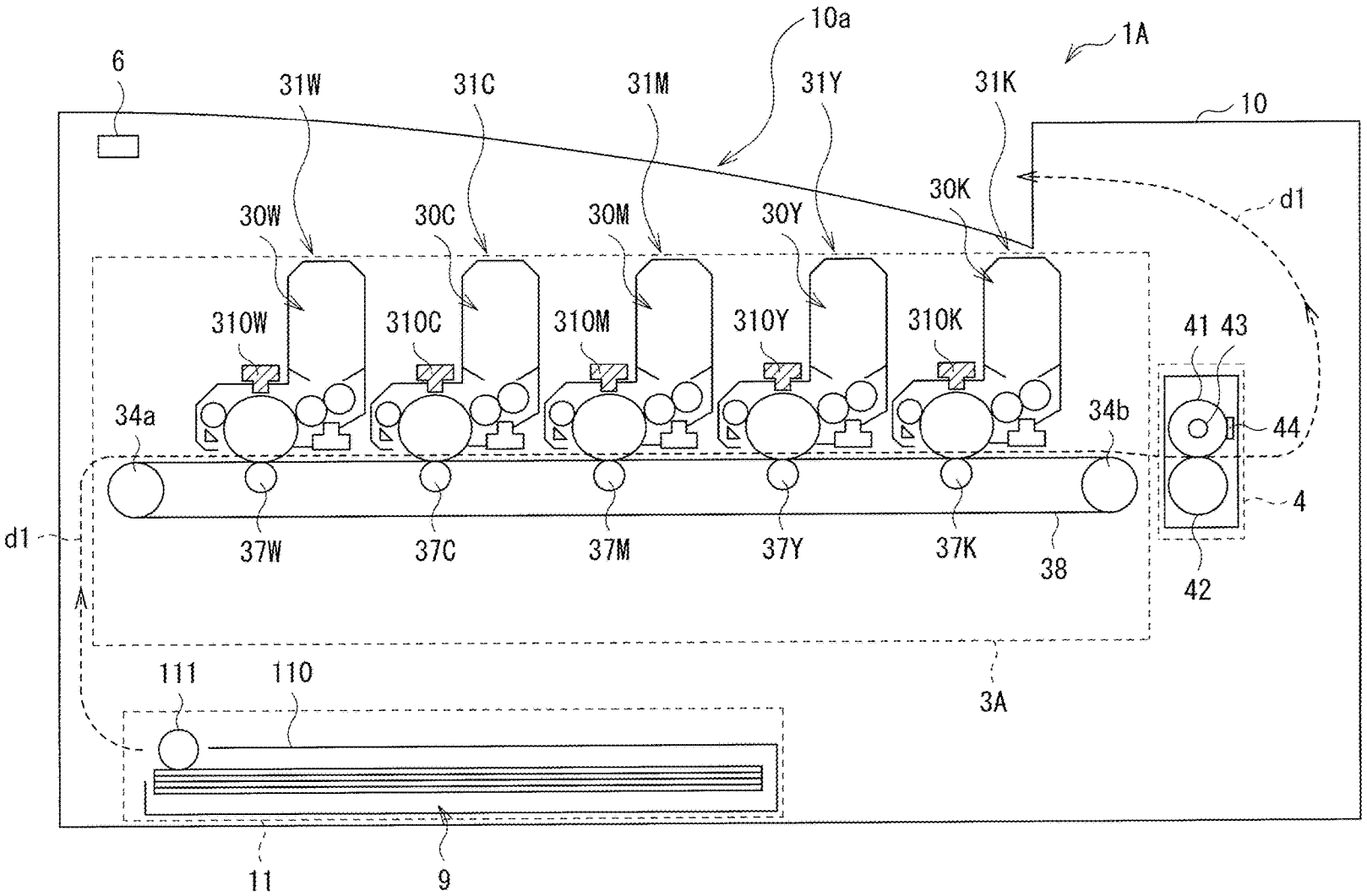
FIG. 11 is a schematic diagram illustrating an outline configuration example of an image forming apparatus according to a modification 2.

FIG. 11 schematically illustrates an outline configuration example of an image forming apparatus (an image forming apparatus 1A) according to the modification 2. Note that illustration of some of components of the image forming apparatus 1 illustrated in FIG. 1 is omitted for simplified illustration. The image forming apparatus 1A may also function as a printer (a color printer in this example) that forms an image (a color image in this example) on the print medium 9 with use of the electro-photography system. The image forming apparatus 1A, however, is an image forming apparatus of the so-called direct transfer system as mentioned above. The image forming apparatus 1A may correspond to a specific but non-limiting example of the "image forming apparatus" in one embodiment of the invention.

As illustrated in FIG. 11, the image forming apparatus 1A may mainly include the feeding mechanism 11, an image forming mechanism 3A, the fixing unit 4, and the environment sensor 6. As illustrated in FIG. 11, these members may be contained in the predetermined housing 10.

In this example, as illustrated in FIG. 11, the image forming mechanism 3A may include the five image drum units (the image forming units) 31K, 31Y, 31M, 31C, and 31W, five transfer rollers 37K, 37Y, 37M, 37C, and 37W, a transfer belt (a conveying belt) 38, the driving roller 34*a*, and the driven roller 34*b*.

As illustrated in FIG. 11, the image drum units 31K, 31Y, 31M, 31C, and 31W may be arranged side by side along the conveying direction (the conveying path) d1 of the print medium 9. More specifically, the image drum units 31W, 31C, 31M, 31Y, and 31K may be arranged in this order along the conveying direction d1 (from upstream toward downstream). The above-described conveying direction d1 in the modification 2 may correspond to a specific but non-limiting example of the "conveying path" in one embodiment of the invention.

The transfer belt 38 may be a belt that conveys the print medium 9 along the conveying direction d1, and as illustrated in FIG. 11, may be so driven by the driving roller 34*a* and the driven roller 34*b* as to be rotationally moved along the conveying direction d1.

The transfer rollers 37K, 37Y, 37M, 37C, and 37W may be members that electrostatically transfer, to the print medium 9, the toner images of the respective colors formed by the respective image drum units 31K, 31Y, 31M, 31C, and 31W. As illustrated in FIG. 11, the transfer rollers 37K, 37Y, 37M, 37C, and 37W may be disposed to respectively face the image drum units 31K, 31Y, 31M, 31C, and 31W with the transfer belt 38 in between.

Figure 12:
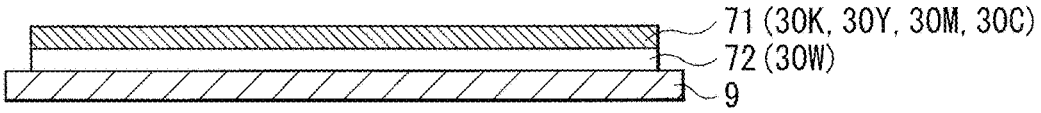
FIG. 12 is a schematic sectional diagram illustrating a transfer state of an image layer and an underlayer in FIG. 11.

As illustrated by way of example in FIG. 12, the underlayer 72 and the image layer 71 may be successively transferred in this order directly to the print medium 9 in the modification 2. Thereafter, the collective fixing operation may be performed by the fixing unit 4 on the image layer 71 and the underlayer 72 that have been thus transferred (directly transferred) to the print medium 9 in the modification 2 as well, similarly to the foregoing example embodiment. Thus, in the modification 2, the printing of the so-called "1-Pass" method (1-Pass printing) may also be performed.

The transfer rollers 37K, 37Y, 37M, 37C, and 37W in the modification 2 may correspond to a specific but non-limiting example of the "transfer section" in one embodiment of the invention.

[Action and Effects]

It is possible to obtain similar effects basically by the action similar to that of the foregoing example embodiment or the modification 1, also in the image forming apparatus 1A having such a configuration.

More specifically, each of the toners 30K, 30Y, 30M, 30C, and 30W in the modification 2 also satisfies the above-described expression (1). In other words, the ratio (the charge amount ratio: E2/E1) of the charge amount E1 of the color toners (the toners 30K, 30Y, 30M, and 30C) and the charge amount E2 of the white toner (the toner 30W) is a value within the range from 0.30 to 1.00. Thus, also in the modification 2, it is possible to obtain the following action and effects as with the foregoing example embodiment or the modification 1.

First, in the case where each of the toners 30K, 30Y, 30M, 30C, and 30W is the negatively-charged toner, the following action is obtained as with the foregoing example embodiment.

Figure 13:
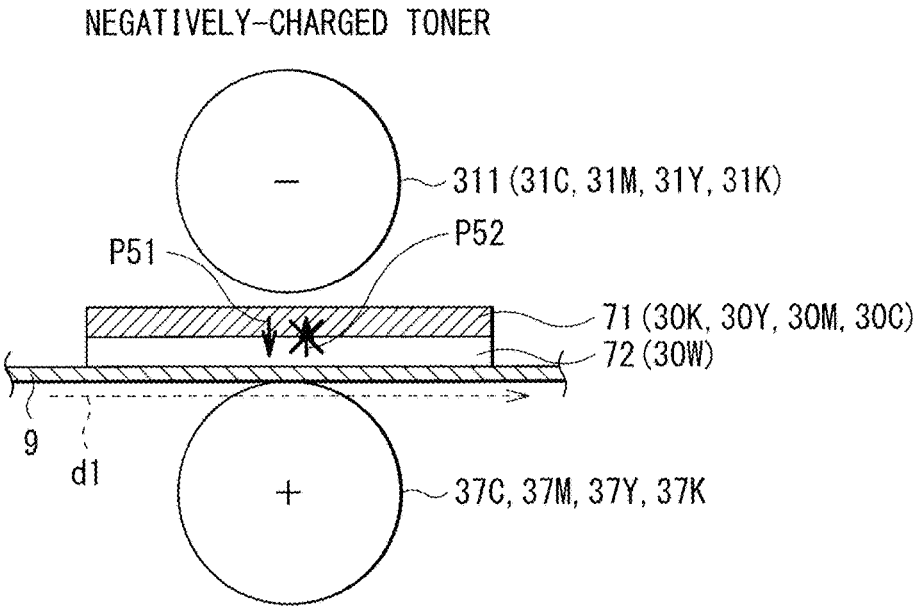
FIG. 13 is a schematic sectional diagram illustrating an example of action of suppressing mixing phenomenon in the modification 2.

In the case where each of the toners 30K, 30Y, 30M, 30C, and 30W is the negatively-charged toner, since the rate of the positive polarity toner is decreased in the toner 30W that forms the underlayer 72, the toner 30W is less drawn to (desirably, not drawn to) the photosensitive drum 311 that is supplied with the voltage of negative (−) polarity upon the direct transfer to the print medium 9, for example, as schematically illustrated in FIG. 13 (refer to an arrow P51 and a symbol "x" in an arrow P52). As a result, the color toners (the toners 30K, 30Y, 30M, and 30C) that form the image layer 71 and the white toner (the toner 30W) that forms the underlayer 72 are less mixed with each other on the print medium 9 upon the direct transfer, making it possible to suppress the occurrence of the mixing phenomenon. In this case, a voltage of positive (+) polarity may be applied to each of the transfer rollers 37K, 37Y, 37M, 37C, and 37W.

In contrast, in the case where each of the toners 30K, 30Y, 30M, 30C, and 30W is the positively-charged toner, the following action is obtained as with the modification 1.

Figure 14:
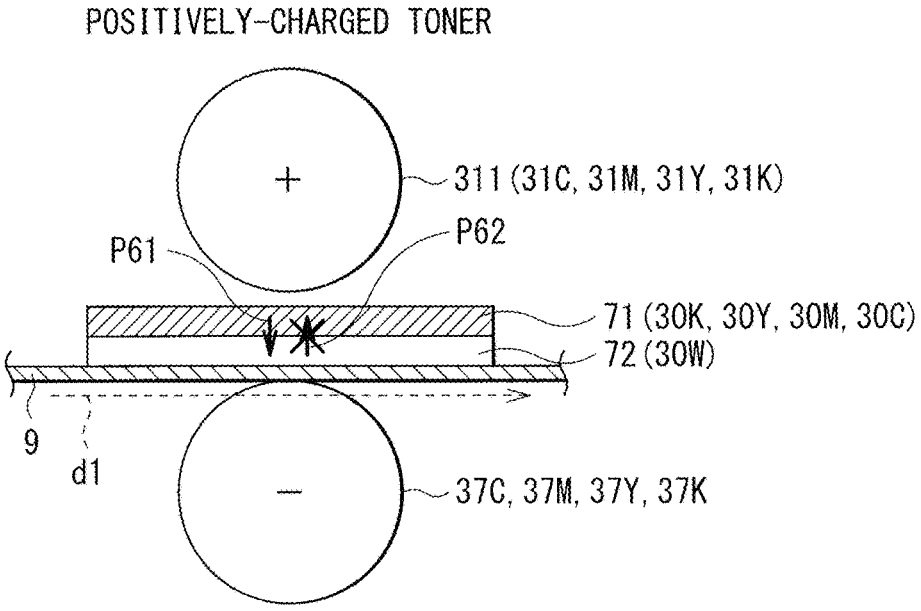
FIG. 14 is a schematic sectional diagram illustrating another example of the action of suppressing the mixing phenomenon in the modification 2.

In the case where each of the toners 30K, 30Y, 30M, 30C, and 30W is the positively-charged toner, since the rate of the negative polarity toner is decreased in the toner 30W that forms the underlayer 72, the toner 30W is less drawn to (desirably, not drawn to) the photosensitive drum 311 that is supplied with the voltage of positive (+) polarity upon the direct transfer to the print medium 9, for example, as schematically illustrated in FIG. 14 (refer to an arrow P61 and a symbol "x" in an arrow P62). As a result, the color toners (the toners 30K, 30Y, 30M, and 30C) that form the image layer 71 and the white toner (the toner 30W) that forms the underlayer 72 are less mixed with each other on the print medium 9 upon the direct transfer, making it possible to suppress the occurrence of the mixing phenomenon. In this case, a voltage of negative (−) polarity may be applied to each of the transfer rollers 37K, 37Y, 37M, 37C, and 37W.

The modification 2 satisfies the above-described expression (1), making it possible to suppress the occurrence of the mixing phenomenon on the print medium 9 upon the transfer (the direct transfer). Hence, it is possible to suppress degradation of color tone of the image on the print medium 9, and to improve print image quality accordingly.

3. Other Modifications

Although the invention has been described with reference to the example embodiment and the modifications, the invention is not limited thereto, and various modifications may be made.

For example, in the example embodiment and the modifications mentioned above, the configurations (such as the shape, the arrangement, the number, and the material) of the respective members in the image forming apparatus have been specifically described. However, the configurations of the respective members are not limited to those described in the example embodiment and the modifications mentioned above, and other shapes, arrangement, number, and materials may be employed. Also, the values, the range, the magnitude relationship, etc. of the various parameters described in the example embodiment and the modifications mentioned above are also not limited to those described in the example embodiment and the modifications mentioned above, and the parameters may be controlled to other values, range, magnitude relationship, etc.

In addition, in the example embodiment and the modifications mentioned above, the case where the underlayer 72 is a monochrome layer configured of a white layer has been described as an example. However, the underlayer 72 is not limited thereto. Alternatively, for example, the underlayer 72 may be a monochrome layer other than the white layer (for example, a metal color layer and a cream color layer). In such a case, an image drum unit that uses a toner (a monochrome developer) of the single color other than the write color may be provided in the image forming apparatus, in place of the image drum unit 31W.

Further, in the example embodiment and the modifications mentioned above, the underlayer 72 has been described as a specific but non-limiting example of the "auxiliary layer" (the layer having an auxiliary function upon the formation of the image layer 71) in one embodiment of the invention. However, the "auxiliary layer" is not limited thereto. Alternatively, a layer (for example, an overcoat layer) other than the underlayer 72 may be applied on an as-needed basis as the "auxiliary layer" in one embodiment of the invention.

In addition, in the example embodiment and the modifications mentioned above, the case where the five image drum units (the five image forming units, or the image drum units 31K, 31Y, 31M, 31C, and 31W) are provided has been described as an example. However, the image drum units are not limited thereto, and may be configured as follows, as long as a plurality of image forming units that form toner images (an "image layer" and an "auxiliary layer" in one embodiment of the invention) of the respective colors with use of the toners of the colors different from one another are provided. For example, the number of image drum units forming the toner images, a combination of colors of toners used in the image drum units, an order of forming the toner images of the respective colors (an arrangement order of the plurality of image drum units) may be set on an as-needed basis depending on applications and purposes.

More specifically, the image forming apparatus of the intermediate transfer system described in the example embodiment and the modification 1 may be configured as follows. One or more "first image forming sections" forming the "image layer" in one embodiment of the invention may be disposed upstream of the "second image forming section" forming the "auxiliary layer" in one embodiment of the invention along the conveying path (the conveying direction d2) of the intermediate transfer belt 33 as the transfer object. In contrast, in the case of the image forming apparatus of the direct transfer system described in the modification 2, one or more "first image forming sections" forming the "image layer" in one embodiment of the invention may be disposed downstream of the "second image forming section" forming the "auxiliary layer" in one embodiment of the invention along the conveying path (the conveying direction d1) of the print medium 9 as the transfer object.

Also, a series of processes described in the example embodiment and the modifications mentioned above may be executed by a hardware (a circuit) or software (a program). In the case where the processes are executed by software, the software is configured of a program group that causes a computer to execute functions. Each program of the program group may be previously incorporated in the above-described computer, or may be installed to the above-described computer through any network or any recording medium for use.

Further, in the example embodiment and the modifications mentioned above, the image forming apparatus having a printing function (the printer) has been described as a specific but non-limiting example of the "image forming apparatus" in one embodiment of the invention; however, the image forming apparatus is not limited thereto. For example, the invention may be applied to an image forming apparatus having a scanner function and a facsimile function (a copier and a facsimile machine), and an image forming apparatus having these functions in a combined fashion (a multifunction peripheral), besides the image forming apparatus having the printing function.

Furthermore, the invention encompasses any possible combination of some or all of the various embodiments and the modifications described herein and incorporated herein.

It is possible to achieve at least the following configurations from the above-described example embodiments of the invention.

(1) An image forming apparatus, including:

a first image forming section that forms an image layer by a first developer;

a second image forming section that forms an auxiliary layer by a second developer; and a transfer section that transfers the image layer formed by the first image forming section and the auxiliary layer formed by the second image forming section sequentially to an object, as a transfer object, on which transfer is to be performed, wherein the following expression (1) is satisfied:

$$0.30 \leq (E2/E1) \leq 1.00 \quad (1)$$

where E1 is a charge amount of the first developer, and E2 is a charge amount of the second developer.

(2) The image forming apparatus according to (1), further including a fixing section that collectively fixes the image layer and the auxiliary layer that are transferred by the transfer section.

(3) The image forming apparatus according to (1) or (2), wherein the first developer has a density within a range from 0.34 $g/cm^3$ to 0.36 $g/cm^3$, and the second developer has a density within a range from 0.55 $g/cm^3$ to 0.60 $g/cm^3$.

(4) The image forming apparatus according to any one of (1) to (3), wherein a transfer voltage of the transfer section is about 2000 V.

(5) The image forming apparatus according to any one of (1) to (4), wherein the first image forming section includes one or more first image forming sections disposed upstream of the second image forming section along a conveying path of an intermediate transfer belt that serves as the transfer object, and the transfer section transfers, on a basis of a primary transfer, the image layer and the auxiliary layer sequentially in this order to the intermediate transfer belt, and transfers, on a basis of a secondary transfer, the image layer and the auxiliary layer of the intermediate transfer belt to a print medium.

(6) The image forming apparatus according to any one of (1) to (4), wherein the first image forming section includes one or more first image forming sections disposed downstream of the second image forming section along a conveying path of a print medium that serves as the transfer object, and the transfer section directly transfers the auxiliary layer and the image layer sequentially in this order to the print medium.

(7) The image forming apparatus according to any one of (1) to (6), wherein the auxiliary layer is a monochrome layer.

(8) The image forming apparatus according to (7), wherein the monochrome layer is a white layer.

(9) The image forming apparatus according to (8), wherein the second developer contains a colorant that includes a titanium oxide.

(10) The image forming apparatus according to any one of (1) to (9), wherein the auxiliary layer is an underlayer of the image layer.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

a first image forming section that forms an image layer by a first developer;

a second image forming section that forms an auxiliary layer by a second developer; and a transfer section that transfers the image layer formed by the first image forming section and the auxiliary layer formed by the second image forming section sequentially to an object, as a transfer object, on which transfer is to be performed, wherein the following expression (1) is satisfied:

$$0.30 \leq (E2/E1) \leq 1.00 \quad (1)$$

where E1 is a charge amount of the first developer, and E2 is a charge amount of the second developer.

2. The image forming apparatus according to claim 1, further comprising a fixing section that collectively fixes the image layer and the auxiliary layer that are transferred by the transfer section.

3. The image forming apparatus according to claim 1, wherein the first developer has a density within a range from 0.34 $g/cm^3$ to 0.36 $g/cm^3$, and the second developer has a density within a range from 0.55 $g/cm^3$ to 0.60 $g/cm^3$.

4. The image forming apparatus according to claim 1, wherein the first image forming section comprises one or more first image forming sections disposed upstream of the second image forming section along a conveying path of an intermediate transfer belt that serves as the transfer object, and the transfer section transfers, on a basis of a primary transfer, the image layer and the auxiliary layer sequentially in this order to the intermediate transfer belt, and transfers, on a basis of a secondary transfer, the image layer and the auxiliary layer of the intermediate transfer belt to a print medium.

5. The image forming apparatus according to claim 1, wherein the first image forming section comprises one or more first image forming sections disposed downstream of the second image forming section along a conveying path of a print medium that serves as the transfer object, and the transfer section directly transfers the auxiliary layer and the image layer sequentially in this order to the print medium.

6. The image forming apparatus according to claim 1, wherein the auxiliary layer is a monochrome layer.

7. The image forming apparatus according to claim 6, wherein the monochrome layer is a white layer.

8. The image forming apparatus according to claim 7, wherein the second developer contains a colorant that includes a titanium oxide.

9. The image forming apparatus according to claim 1, wherein the auxiliary layer is an underlayer of the image layer.

10. The image forming apparatus according to claim 1, wherein each of the first developer and the second developer includes a negatively-charged developer.

11. The image forming apparatus according to claim 10, further comprising:

a secondary transfer member with a non-negative voltage supplied thereto; and a secondary transfer counter member with a negative voltage supplied thereto.

12. The image forming apparatus according to claim 1, wherein each of the first developer and the second developer includes a positively-charged developer.

13. The image forming apparatus according to claim 12, further comprising:

a secondary transfer member with a negative voltage supplied thereto; and a secondary transfer counter member with a non-negative voltage supplied thereto.

14. The image forming apparatus according to claim 1, wherein an attachment amount, on the transfer object, of the first developer is in a range from 0.4 $mg/cm^2$ to 0.6 $mg/cm^2$, and an attachment amount, on the transfer object, of the second developer is in a range from 0.7 $mg/cm^2$ to 1.1 $mg/cm^2$.

15. The image forming apparatus according to claim 14, wherein the attachment amount, on the transfer object, of the first developer is in a range from 0.4 $mg/cm^2$ to 0.5 $mg/cm^2$, and the attachment amount, on the transfer object, of the second developer is in a range from 0.8 $mg/cm^2$ to 1.0 $mg/cm^2$.

* * * * *